US006987434B2

(12) United States Patent
An et al.

(10) Patent No.: US 6,987,434 B2
(45) Date of Patent: Jan. 17, 2006

(54) NON-RADIATIVE DIELECTRIC WAVEGUIDE MODULATOR HAVING WAVEGUIDE TYPE HYBRID COUPLER

(75) Inventors: Jae We An, Ulsan (KR); Young Geun Yoo, Ulsan (KR); Myoung Yeul Park, Ulsan (KR); Dong Jin Jo, Ulsan (KR)

(73) Assignee: Comotech Corporation, Ulsan (KR)

( * ) Notice: Subject to any disclaimer, the term of this patent is extended or adjusted under 35 U.S.C. 154(b) by 44 days.

(21) Appl. No.: 10/752,686

(22) Filed: Jan. 8, 2004

(65) Prior Publication Data

US 2005/0122193 A1 Jun. 9, 2005

(30) Foreign Application Priority Data

Dec. 3, 2003 (KR) ..... 10-2003-0087344

(51) Int. Cl.
*H01P 3/16* (2006.01)
*H01P 1/24* (2006.01)
*H03C 1/00* (2006.01)

(52) U.S. Cl. ..... 333/250; 333/248; 333/22 R; 333/81 R; 333/117; 332/149; 332/178; 455/313; 455/323; 375/320

(58) Field of Classification Search ..... 333/248, 333/250, 22 R, 81 R, 117; 455/313, 323; 375/320; 332/149, 178
See application file for complete search history.

(56) References Cited

U.S. PATENT DOCUMENTS 5,920,245 A * 7/1999 Ishikawa et al. ..... 333/248
6,867,660 B2 * 3/2005 Kitamori et al. ..... 333/21 R
6,868,258 B2 * 3/2005 Hayata et al. ..... 455/81
6,871,056 B2 * 3/2005 Cho et al. ..... 455/313

FOREIGN PATENT DOCUMENTS

JP 2002-232212 * 8/2002

* cited by examiner

*Primary Examiner*—Barbara Summons
(74) *Attorney, Agent, or Firm*—Nixon Peabody LLP

(57) ABSTRACT

A non-radiative dielectric (NRD) waveguide modulator is provided having a waveguide type hybrid coupler, in which by forming a waveguide type 180° hybrid coupler and waveguide as a single body, the structure is simplified and manufacturing processes are reduced. The NRD waveguide modulator includes a conducting housing having a lower conducting plate and an upper conducting plate; a hybrid coupler which is processed in the form of conduit lines inside the conducting housing and includes a ring portion and a plurality of waveguides extended from the ring portion in the radial direction, in modulator, and a termination which is connected to an isolation port that is an end of any one waveguide of the hybrid coupler and terminates a signal reflected by the modulator by consuming the signal internally.

8 Claims, 7 Drawing Sheets

NON-RADIATIVE DIELECTRIC WAVEGUIDE MODULATOR HAVING WAVEGUIDE TYPE HYBRID COUPLER

BACKGROUND OF THE INVENTION

1. Field of the Invention

The present invention relates to a modulator using a non-radiative dielectric waveguide, and more particularly, to a non-radiative dielectric waveguide modulator having a waveguide type hybrid coupler in which a hybrid coupler, which distributes and propagates a local oscillation signal entered from a local oscillator to a mixer of a reception unit and a modulator, is formed with conduit-shape waveguides in a conducting housing, and dielectric lines combined with the waveguides as a single body are accommodated and disposed in the conducting housing such that the structure is simplified and the manufacturing processes are reduced.

2. Description of the Related Art

Recently, research efforts have been made to implement wireless communications using transceivers in a millimeter wave band area for high speed large capacity wireless communications. As wireless communications system used in a millimeter wave band, systems mainly using waveguides had been widely used, but more recently, thanks to the semiconductor technology development, the system has been developed as a single chip called monolithic microwave integrated circuit (MMIC). The method using a waveguide, which can be referred to as a hybrid type, falls behind the MMIC in mass production and market price, but is more advantageous in small volume production.

Since a non-radiative dielectric (NRD) waveguide having less transmission loss than this method using a waveguide has been introduced first in the early 1980s, a lot of efforts to commercialize the NRD waveguide have been made and transceivers using the NRD waveguide have been actively manufactured. The NRD waveguide transfers a signal at a low loss rate through a longitudinal section magnetic (LSM) mode and by using this NRD waveguide, a circuit which provides easy compatibility with existing waveguides while maintaining the advantages of both type waveguides.

FIGS. 1*a* and 1*b* are a perspective view and a plan view, respectively, of the structure of a prior art modulator using NRD waveguides.

As shown, the prior art modulator comprises a directional coupler 10, a circulator 20, and a modulator 30. The directional coupler 10 transfers a local oscillation signal to a transmission unit and a reception unit in a transceiver, and is formed by disposing a pair of dielectric lines 12 and 14 between an upper conducting plate 40 and a lower conducting plate 50. At this time by adjusting the gap between the two dielectric lines 12 and 14, the coupling amount of the directional coupler 10 is adjusted and in order to obtain a wider bandwidth, the dielectric lines 12 and 14 should be curved as shown. A local oscillation signal generated in a local oscillator (not shown) is entered into a signal input port 12*a*, and this signal is propagated to the circulator 20 and a mixer port of the reception unit, respectively, by the directional coupler 10. An isolation port of this directional coupler 10 should be terminated by using a termination 16 and this termination 16 is formed by inserting a resisting sheet 16*a* into the dielectric line 14. Because it is very difficult to manufacture this curved dielectric line 14 and termination 16 and to obtain uniform characteristics, these are not appropriate for mass production.

The circulator 20 is a unidirectional device providing a signal path only in one direction. This circulator 20 is connected to three dielectric lines 12, 22, and 24 so that the local oscillation signal transferred from the directional coupler 10 is transferred to the modulator 30. More specifically, the local oscillation signal is input to the circulator 20 through the directional coupler 10, this signal is entered into the modulator 30 by the circulator 20, and the modulated signal reflected at the modulator 30 is output to a modulated signal output port 24*a*.

This circulator 20 is formed by disposing the three dielectric lines 12, 22, and 24 at each 120° angle interval, and disposing an annular dielectric resonator 26 at the point where the three dielectric lines 12, 22, and 24 come together. Ferrite or rubber magnets are placed on the top and bottom of the annular dielectric resonator 26 and then, by using a permanent magnet, are magnetized such that the unidirectional characteristic can be obtained. In order to suppress generation of a longitudinal section electric (LSE) mode occurring in these three dielectric lines 12, 22, and 24 in addition to the LSM mode that is the basic mode, an LSE mode suppressor is inserted into the center of the dielectric lines 12, 22, and 24. Because it is difficult to manufacture the circulator 20 with the structure described above and to obtain uniform characteristics, the circulator 20 is not appropriate for mass production.

The modulator 30 comprises a Schottky diode (not shown) and by switching the local oscillation signal entered through the circulator 20 by the switching operation of the Schottky diode, modulation is performed. To this Schottky diode, a predetermined bias voltage is input and by grounding, a closed circuit is formed. That is, when the Schottky diode is on, a local oscillation signal entered into the modulator 30 is transferred to the ground and when the Schottky diode is off, is totally reflected and is output to the modulated signal output port 24*a* through the circulator 20, and thus amplitude shift keying (ASK) modulation is performed. A digital pulse signal that is an information signal is entered into an information signal entrance hole 32 connected to a Schottky diode mount 33, and switches the Schottky diode mounted on the Schottky diode mount 33. At this time, in order to match the Schottky diode mount 33 and a local oscillation signal, an air gap 34, a front side dielectric line 35, a high dielectric constant sheet 36, and a back side dielectric line 37 are used. Also, a patch antenna 33*a* of the diode mount 33 should be designed to fit the frequency of a local oscillation signal. Because the sizes of the air gap 34, the front side dielectric line 35, the high dielectric constant sheet 36, and the back side dielectric line 37 are very small, and consequently it is very difficult to manufacture these modules and to obtain uniform characteristics, these are not appropriate for mass production.

By using the principle of a parallel dielectric line coupler, a dielectric line is made to be bent and data on linewidths of dielectric lines 12 and 14 appropriate to each bend angle are established and then the directional coupler 10 as described above is designed. However, in this dielectric coupler 10, when it is desired to make a small-sized one, the bend angle cannot be reduced and if the bend is more curved, loss occurs unless the linewidths of the dielectric lines 12 and 14 should be reduced by different width with respect to angles corresponding to respective frequencies. However, it is very difficult to apply this constraint to the actual manufacturing. Also, when this directional coupler is to be mass produced, it is difficult to obtain an accurate dielectric line interval or bending angle and the isolation degree between ports is degraded. Furthermore, when in order to implement a lighter and smaller product it is desired to reduce the size further, the linewidth of the bend part should be reduced in order to increase the bending angle. However, it is difficult to accurately reduce the linewidth of the dielectric line made of Teflon and the like and therefore the actual implement is very difficult.

SUMMARY OF THE INVENTION

The present invention provides a non-radiative dielectric (NRD) waveguide modulator having a waveguide type hybrid coupler, in which by forming a waveguide type 180° hybrid coupler and waveguides as a single body, the structure is simplified and manufacturing processes are reduced such that consistency of characteristics is maintained, manufacturing time and cost are reduced, and consequently, manufacturability is improved.

According to an aspect of the present invention, there is provided a non-radiative dielectric (NRD) waveguide modulator comprising: a conducting housing which comprises a lower conducting plate and an upper conducting plate combined with the lower conducting plate; a hybrid coupler which is disposed inside the conducting housing and is formed in a structure in which a plurality of waveguides processed as conduit-shape cavities are connected to the outer surface of a ring portion processed as a ring-shape cavity, with having a predetermined phase difference, and are extended in the radius direction, and a local oscillation signal input through any one of the plurality of waveguides is distributed to at least two waveguides and propagated; a modulator in which a dielectric line, which includes a diode mount on which a Schottky diode is mounted, is solidly disposed inside a modulator cavity inside the conducting housing, and the dielectric line is connected to any one waveguide of the hybrid coupler, and which modulates a local oscillation signal input through the dielectric line by using the Schottky diode and outputs the modulated signal to the outside; and a termination which is connected to an end of any one waveguide terminating the local oscillation signal, among the plurality of waveguides of the hybrid coupler, and terminates a signal reflected by the modulator by consuming the signal internally.

BRIEF DESCRIPTION OF THE DRAWINGS

The above objects and advantages of the present invention will become more apparent by describing in detail preferred embodiments thereof with reference to the attached drawings in which.

DESCRIPTION OF THE PREFERRED EMBODIMENTS

A modulation method applied to the embodiments of the present invention is an amplitude shift keying (ASK) modulation. In the present apparatus, in order to modulate a high speed large capacity signal into an ASK modulated signal, a Schottky diode which is a high speed switching device is used and by using this, a local oscillation (LO) signal is switched to perform ASK modulation. In particular, the present modulator is manufactured by applying a non-radiative dielectric (NRD) waveguide technology which is easy to manufacture and has a less transmission loss. At this time, in order to transfer an input local oscillation signal to a Schottky diode, a hybrid coupler is formed in the form of a waveguide in a conducting housing as a single body such that the structure of the modulator is simplified. In addition, a termination connected to the hybrid coupler is also formed as a waveguide in the conducting housing and a modulator is also formed in the conducting housing. Referring to FIGS. 2*a* through 6, this will now be explained in detail.

Figure 1A:
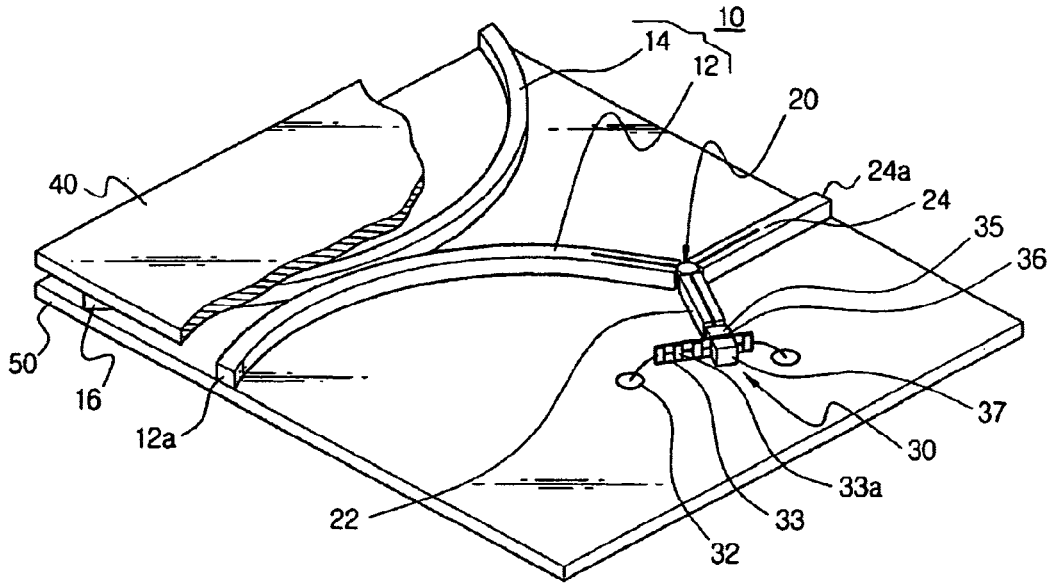
FIG. 1A Prior Art
FIG. 1*a* is a perspective view of the structure of a prior art modulator using a non-radiative dielectric (NRD) waveguide.
Figure 1B:
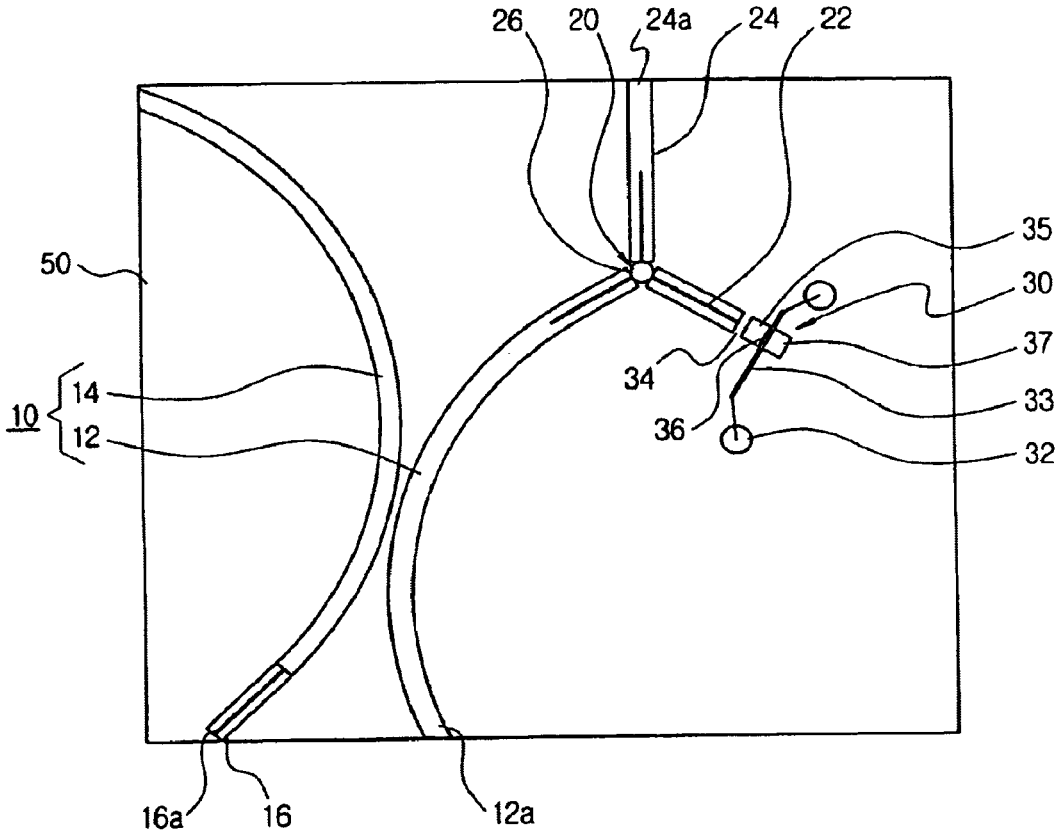
FIG. 1B Prior Art
FIG. 1*b* is a plan view of the structure of FIG. 1*a;*
Figure 2A:
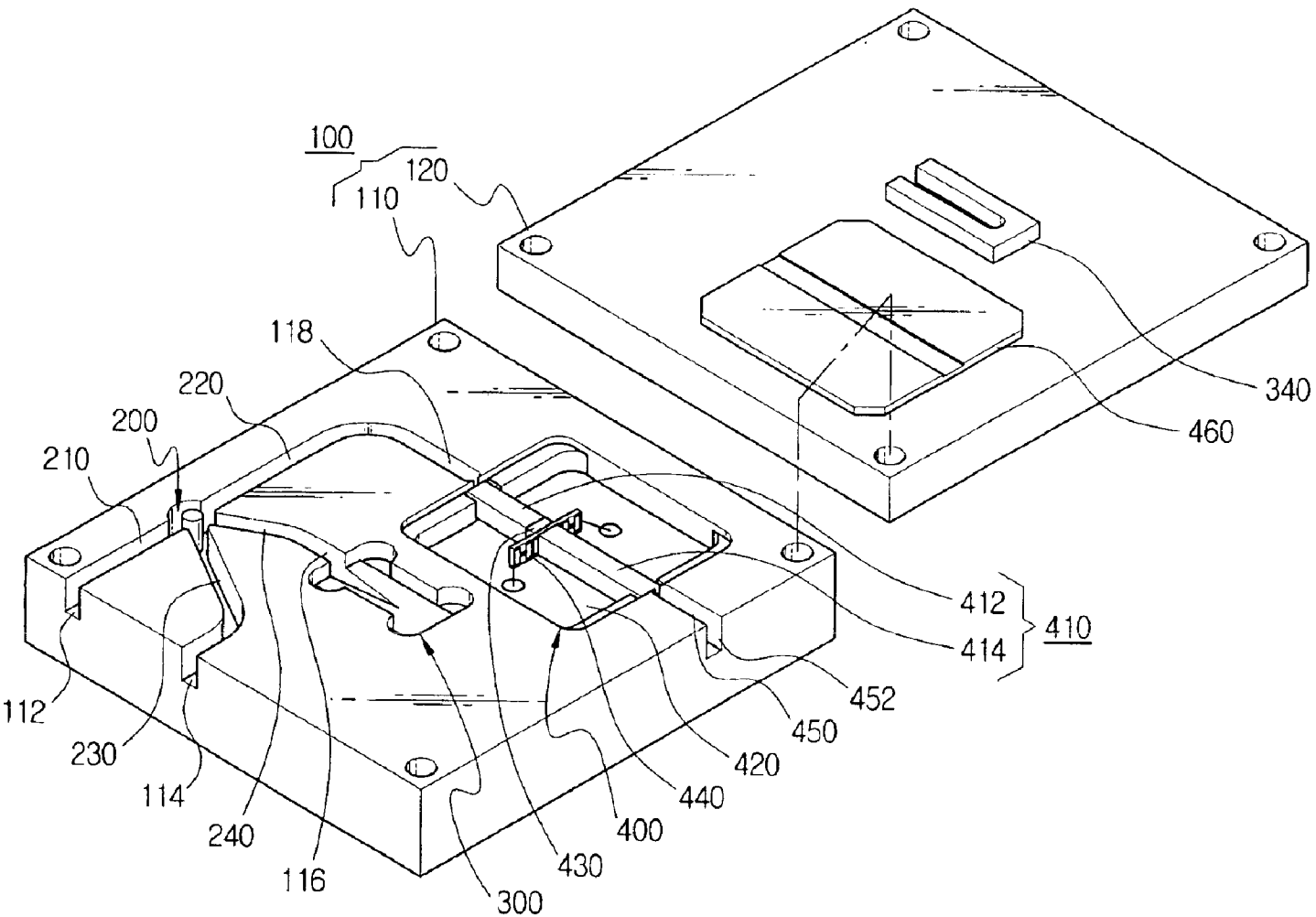
FIG. 2*a* is an exploded perspective view of the entire structure of an NRD waveguide modulator having a waveguide type coupler according to the present invention.
Figure 2B:
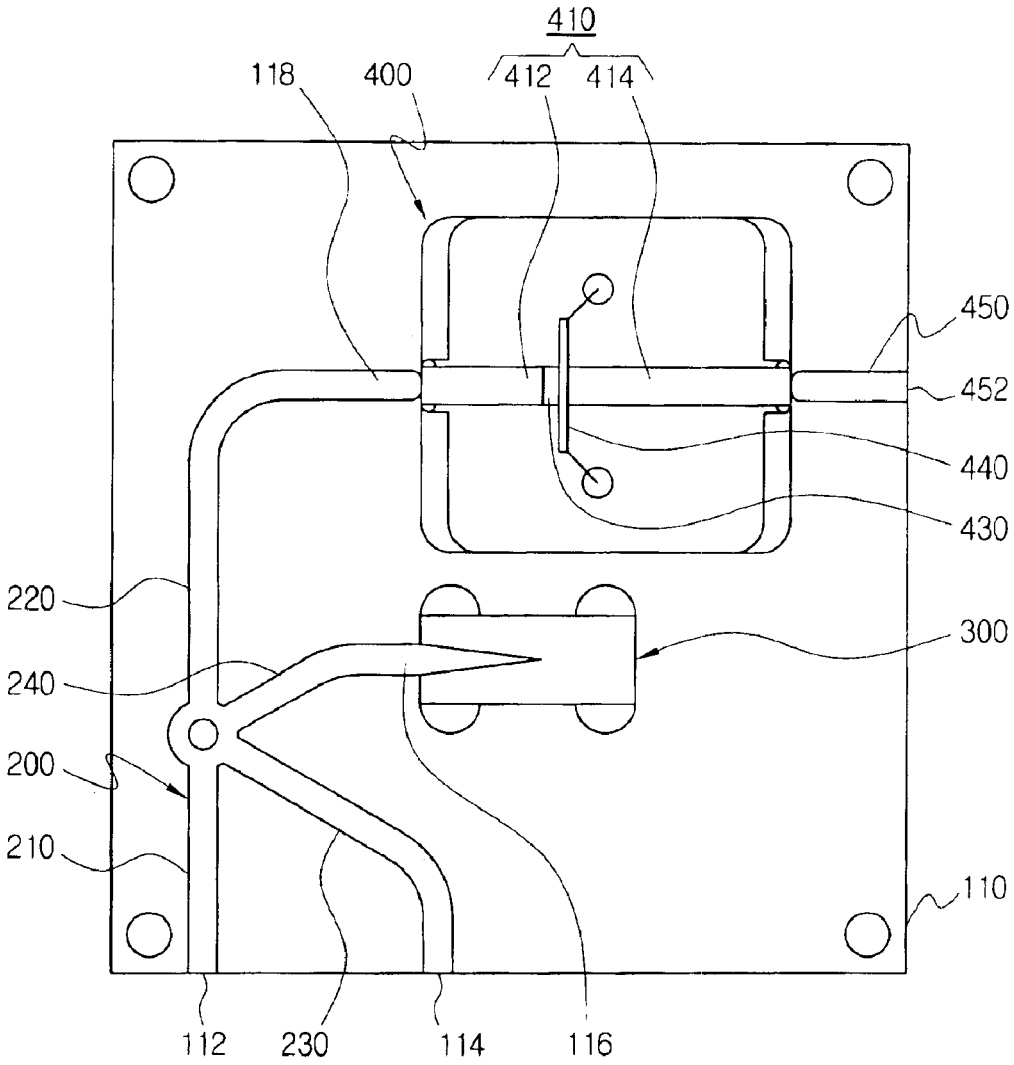
FIG. 2*b* is a plan view of a lower conducting plate of FIG. 2*a* which is seen from the upside.

FIG. 2*a* is an exploded perspective view of the entire structure of an NRD waveguide modulator having a waveguide type coupler according to the present invention, and FIG. 2*b* is a plan view of a lower conducting plate of FIG. 2*a* which is seen from the upside.

The modulator has a conducting housing 100 comprising a lower conducting plate 110 and an upper conducting plate 120 combined with the lower conducting plate 110, and has a hybrid coupler 200, a termination 300, and a modulator 400 embedded in this conducting housing 100. In the present embodiment, the hybrid coupler 200, termination 300, and modulator 400 are formed on the lower conducting plate 110 and the upper conducting plate 120 functions as a cover. However, inversely, these elements may be formed on the upper conducting plate 120 and the lower conducting plate 110 may be used as a cover. The structure of the core elements of the present invention, the hybrid coupler 200, the termination 300, and the modulator 400, will now be explained in detail.

The hybrid coupler 200 is formed in the form of waveguides as an integral part in the lower conducting plate 110 by mechanical processing, and preferably, is formed as a 180° hybrid coupler 200 which changes the direction of a local oscillation signal input through a signal input port 112 by 180° and then transfers to the modulator 400. This 180° hybrid coupler 200 has four branches connected to waveguides 210 through 240. More specifically, a signal input port 112 to which a local oscillation signal is input is formed at the end of a first waveguide 210, the modulator 400 is connected to the end of a second waveguide 220, a mixer input port 114 which is connected to a mixer of a reception unit (not shown) is formed at the end of a third waveguide 230, and an isolation port 116 which is connected to the termination is formed at the end of a fourth waveguide 240. Accordingly, a local oscillation signal input to the signal input port 112 of the 180° hybrid coupler 200 is distributed to the mixer input port 114 and the modulator input port 118 and the isolation port 116 is terminated by the termination 300. This termination 300 is an element terminating the isolation port 116 and the detailed structure will be explained in detail referring to FIGS. 4*a* and 4*b*.

The 180° hybrid coupler 200 described above has a waveguide shape and the part of the modulator 400 connected to the hybrid coupler 200 is a dielectric line. Accordingly, there is a transition unit to change a line when a local oscillation signal distributed by the hybrid coupler 200 is transferred to the dielectric line of the modulator 400. This transition unit is made in the form of a transformer with a length of λg/4 and low impedance reduced by shortening the distance between the dielectric line 410 and both side surfaces of conductor, and is disposed at the input end and output end of the modulator 400.

The modulator 400 connected to the end of the modulator input port 118 of the hybrid coupler 200 is formed by disposing dielectric lines 410 in a modulator cavity 420 formed on the lower conducting plate 110, connected to the second waveguide 220, and combining a high dielectric constant sheet 430 for matching of the modulator 400 and a Schottky diode mount 440 having a Schottky diode with the dielectric lines 410. This modulator 400 will be explained in detail referring to FIGS. 5*a* through 6. To the back end of the modulator 400, a waveguide 450 through which a signal modulated by the Schottky diode is output is connected, and a modulated signal output port 452 through which a modulated signal is output is formed at the end of the waveguide 450.

Reference number 340 not described above indicates a termination upper conducting plate and reference number 460 indicates a modulator upper conducting plate and these are integrally formed on the bottom surface of the upper conducting plate 120.

Figure 3:
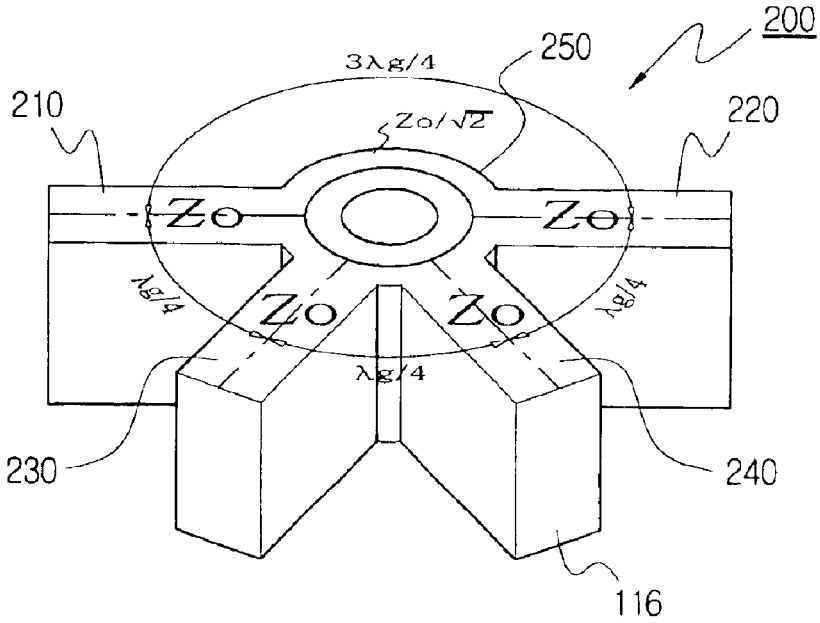
FIG. 3 is a partially extracted detailed perspective view of a waveguide type hybrid coupler shown in FIG. 2*a;*

FIG. 3 is a partially extracted detailed perspective view of a waveguide type hybrid coupler shown in FIG. 2*a*.

As shown, at the center of the 180° hybrid coupler 200, four waveguides 210 through 240 are connected to each other and among them, the first and second waveguides 210 and 220 have a 180° phase difference. The characteristic impedance of each waveguide 210 through 240 is $Z_0$ and the characteristic impedance of the central part line formed by a ring portion 250 to which the waveguides 210 through 240 are converging is $Zo/\sqrt{2}$. In the waveguide type hybrid coupler 200, the interval between the first and second waveguides 210 and 220 is 3 λg/4, and the interval between the first and third waveguides 210 and 230, that between the third and fourth waveguides 230 and 240, and that between the fourth and second waveguides 240 and 220 are λg/4 each. Here, λg means the wavelength inside a waveguide. Accordingly, if the interval λg/4 of the first and third waveguides 210 and 230 is subtracted from the interval 3 λg/4 of the first and second waveguides 210 and 220, the interval of the second and third waveguides 220 and 230 becomes λg/2 and consequently the phase difference becomes 180°. A local oscillation signal entered into the first waveguide 210 of the waveguide type 180° hybrid coupler 200 is propagated into the second and third waveguides 220 and 230, in particular the signal propagated to each direction of the ring portion 250 is transferred to each waveguides 220 and 230 having the same phase from the first waveguide 210 to be divided as each half the power of the signal. In the fourth waveguide 240, the phase of a signal propagated to each direction of the ring portion 250 becomes an opposite phase and the signal is canceled, and therefore the end part of the fourth waveguide 240 becomes the isolation port 116. At this isolation port 116, a waveguide type termination is disposed. This termination plays a role of consuming the signal entered from the modulator described above, to terminate the signal. Also, in signals output to the second waveguide 220 and to the third waveguides 230, the phase difference of the traveling distances of the signals is 180°, and accordingly the phase of a signal output to the second waveguide 220 and that to the third waveguides 230 are opposite.

The interval between each waveguide of the hybrid coupler 200 shown in this embodiment is just a preferred embodiment and the interval can be adjusted in any appropriate manners. That is, even though the interval between each waveguide 210 through 240 is increased by half a wavelength (λg/2) or a wavelength (λg), the only requirement is to match the phase difference between waveguides. In addition, changing the position of each waveguide does not matter. For example, if the third waveguide 230 is an input port for a local oscillation signal, each half of the power of the signal is distributed and propagated to either of the first and fourth waveguides 210 and 240 and a port connected to the second port 220 will be an isolation port.

Figure 4A:
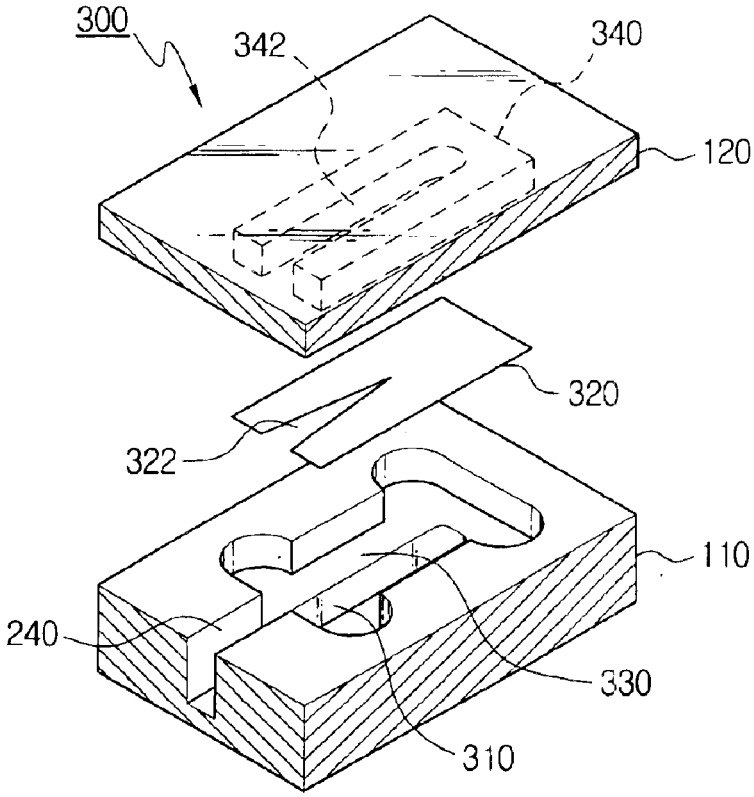
FIG. 4*a* is a partially extracted detailed perspective view of the structure of a termination shown in FIG. 2*a;*
Figure 4B:
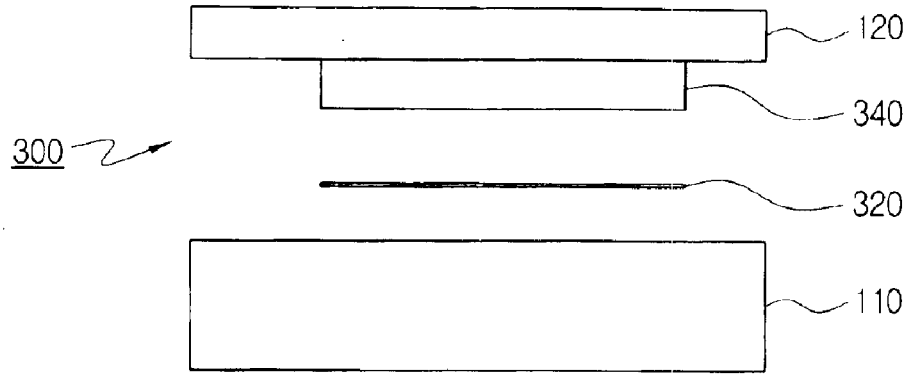
FIG. 4*b* is a side view of the termination of FIG. 4*a;*

FIG. 4*a* is a partially extracted detailed perspective view of the structure of a termination shown in FIG. 2*a*, and FIG. 4*b* is a side view of the termination of FIG. 4*a*.

At the isolation port of the fourth waveguide 240 formed on the lower conducting plate 110, the termination 300 is disposed. This termination 300 has a structure in which a waveguide 310 is cut at the center and a resisting sheet 320 is inserted between the two cut parts. More specifically, a resisting sheet mounting portion 330 wider than the width of the waveguide 310 is formed on the lower conducting plate 110 and at a position corresponding to a height half that of the waveguide 310. By solidly mounting a resisting sheet 320 on this resisting sheet mounting portion 330 and covering the upper conducting plate 120 having the termination upper conducting plate 340 fixed at the bottom surface, the termination 300 is constructed. This termination upper conducting plate 340 may be integrally formed at the bottom surface of the upper conducting plate 120 as in the present embodiment, or may be formed separately. In the termination upper conducting plate 340, a groove 342 which has the same width as that of the waveguide 310 and a height half that of the waveguide 310, and forms the upper half of the waveguide 310, is formed. If the termination upper conducting plate 340 is solidly mounted on the resisting sheet and held in the resisting sheet mounting portion, the groove 342 and the bottom half of the waveguide 310 of the lower conducting plate 110 form a complete waveguide and the resisting sheet 320 is inserted in the middle in the height direction. In the resisting sheet 320 as shown in FIG. 4*a*, a V-shape groove 322 in which the width is narrowing with decreasing distance to the vertex is formed on the front side. The length and shape of this resisting sheet 320 may be changed a little with respect to frequency in order to match impedance. The resisting sheet 320 terminates a signal entered into the termination 300 by consuming the power of the signal.

Figure 5A:
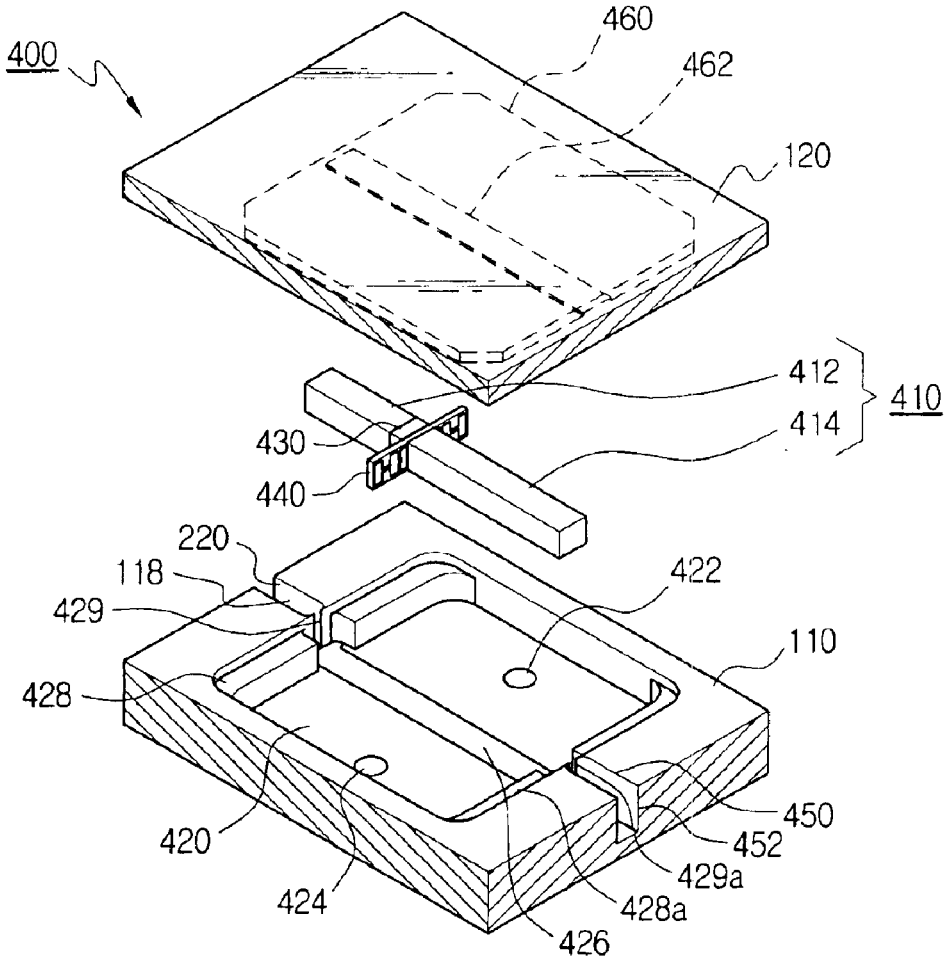
FIG. 5*a* is a partially extracted detailed perspective view of the structure of a modulator part shown in FIG. 2*a;*
Figure 5B:
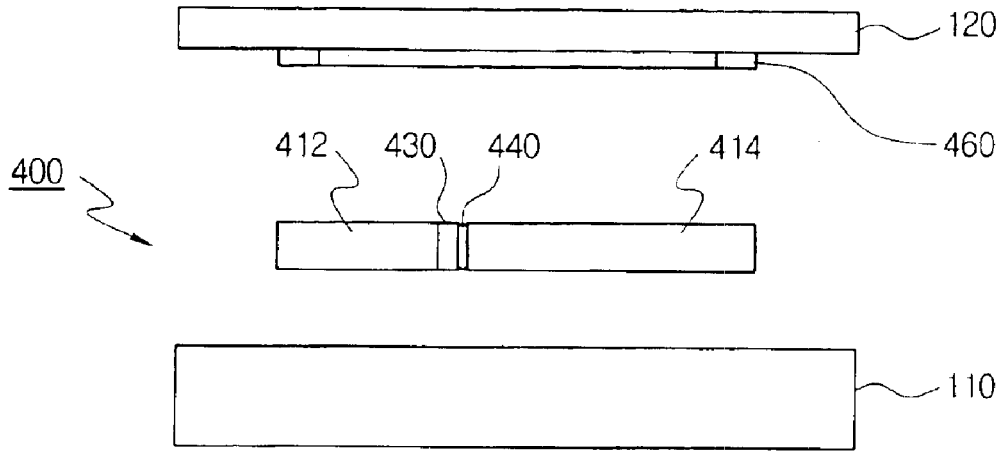
FIG. 5*b* is a side view of the modulator part of FIG. 5*a*.

FIG. 5*a* is a partially extracted detailed perspective view of the structure of a modulator part shown in FIG. 2*a*, and FIG. 5*b* is a side view of the modulator part of FIG. 5*a*.

As shown in FIG. 5*a*, the modulator 400 has a modulator cavity 420 which is connected to the modulator input port 118 of the hybrid coupler and is a widening space in the lower conducting plate 110, and has a dielectric line 410 connected to the waveguide 220 and mounted on the modulator cavity 420. This dielectric line 410 is formed with a front side dielectric line 412 and a back side dielectric line 414, and a diode mount 440 on which a Schottky diode is mounted is disposed between these front and back side dielectric lines 412 and 414. In particular, a high dielectric constant sheet 430 is disposed at the end part of the front side dielectric line 412 and is in contact with the diode mount 440. In addition, both ends of the diode mount 440 are connected to an information signal entering hole 422 and a ground hole 424, by which an operation signal is transferred to the Schottky diode.

By inserting a predetermined small part of the bottom part of the dielectric line 410 into a line position groove 426 formed on the modulator cavity 420, the front and back side dielectric lines 412 and 414 are fixed and then, by covering the upper conducting plate 120 on the top part of the front and back side dielectric lines 412 and 414, the top open part of the modulator cavity 420 is closed by the modulator upper conducting plate 460 formed on the bottom surface of the upper conducting plate 120. Mounting protrusions 428 and 428*a* for the modulator upper conducting plate 460 to be mounted are formed on both side walls forming the modulator cavity 420. On the bottom surface of the modulator upper conducting plate 460, a line support groove 462 corresponding to the line position groove 426 is formed and small part of the top part of the front and back side dielectric lines 412 and 414 is inserted into the line position groove 426 such that the top and bottom part of the dielectric lines are held and support by the line support groove 462 and the line position groove 426. These line position groove 426 and line support groove 462 contribute to remove assembly errors and maintain consistency in characteristics, as well as to select a position and fix the dielectric lines 412 and 414. Thus, by disposing the dielectric line 410 between the upper and lower conducting plates 110 and 120, the modulator 400 is formed as an NRD waveguide type.

Since the signal propagation path for a local oscillation signal entering into the modulator 400 with the structure described above changes from the waveguide 220 to the NRD line 412, a transition 429 for transformation is disposed at the input side of the modulator 400, which is the front part of the modulator 400. A transition 429*a* is also disposed at the output side of the modulator 400, which is the back part of the modulator 400, to change a signal propagation path form the NRD line 414 to the waveguide 450 such that compatibility of the output port 452 of the modulator 400 with other waveguide components is enhanced. This transition 429 and 429*a* is formed with a transformer with a length of $\lambda g/4$ by shortening the side walls of the NRD waveguide to reduce impedance, and plays a role of matching impedances of waveguides and NRD waveguides.

Figure 6:
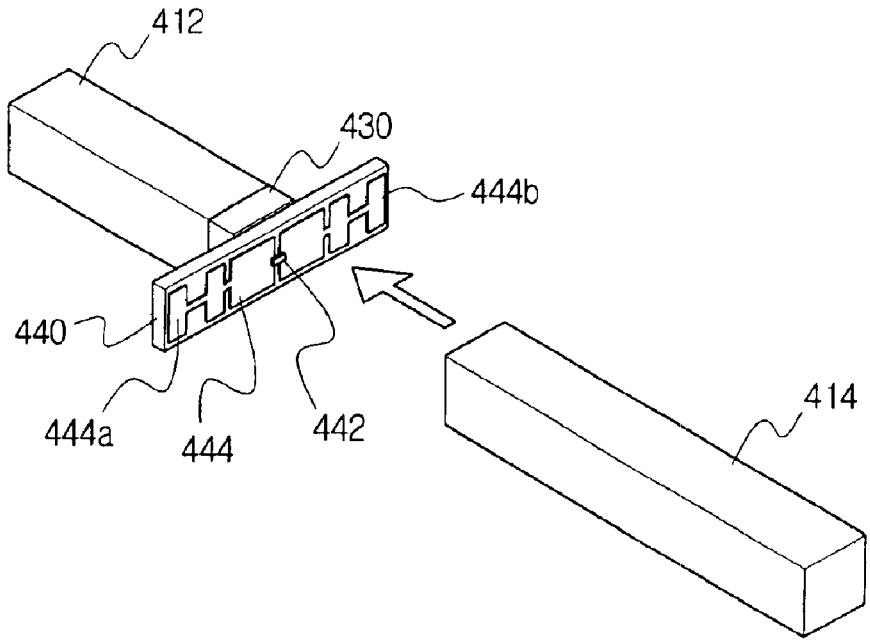
FIG. 6 is a partially extracted sectional perspective view showing the combination structure of a diode mount and dielectric lines in detail.

FIG. 6 is a partially extracted sectional perspective view showing the combination structure of a diode mount and dielectric lines in detail. A local oscillation signal entering into the modulator 400 is ASK modulated by being switched by the switching operation of the Schottky diode 442. This switching operation of the Schottky diode 442 is performed by an information signal entered into an information signal entering hole. For smooth switching, matching of the NRD line 410 and the diode mount 440 on which the Schottky diode 442 is mounted at the frequency of an entered local oscillation signal is needed. For this matching, a high dielectric constant sheet 430 is disposed between the front side dielectric line 412 and the diode mount 440, and a patch antenna 444 to fit the frequency of a local oscillation signal is disposed on the diode mount 440. At both ends of this patch antenna 444, RF chokes 444*a* and 444*b* are attached so that a local oscillation signal does not flow into the information signal entering hole or the ground hole. In order to induce matching with respect to the frequency of a local oscillation signal, the positions of the diode mount 440 and the high dielectric constant sheet 430 may be exchanged.

Referring to attached drawings, the operation of the present invention will now be explained in detail.

A local oscillation signal oscillated in a local oscillator is entered into the signal input port 112 of the present apparatus. Then, the local oscillation signal propagated to each direction of the ring portion 250 in the 180° hybrid coupler 200 from the first waveguide 210 is propagated to the second and third waveguides 220 and 230 having the same phase, in which the power of the signal is divided into two, each half propagated to one of the waveguides 220 and 230. The phase of the signal propagated to the fourth waveguide 240 becomes opposite to that of a signal propagated from the ring portion 250 by the termination 300 and the signal is terminated. At this time, the signal propagated to the second waveguide 220 is transferred to the modulator 400 after the signal propagation path changes from a waveguide to an NRD waveguide through the transition 429 disposed at the front end of the modulator 400. The signal thus transferred to the front side dielectric line 412 is switched and modulated while the Schottky diode 442 performs switching operations according to an information signal entering into the information signal entering hole 422. Thus modulated signal is transferred to the modulated signal output port 452 through the back side dielectric line 414 in the modulator 400 and the waveguide 450. At this time, by passing through the transition 429*a* disposed at the back end of the back side dielectric line 414, the signal propagation path changes into the waveguide 450 and the signal is propagated to the modulated signal output port 452.

Optimum embodiments have been explained above. However, it is apparent that variations and modifications by those skilled in the art can be effected within the spirit and scope of the present invention defined in the appended claims. Therefore, all variations and modifications equivalent to the appended claims are within the scope of the present invention.

Among a variety of possible embodiments, the embodiments disclosed here are selected as preferred examples to help understanding of those skilled in the art. It is noted that the present invention is not limited to the preferred embodiment described above, and it is apparent that variations and modifications by those skilled in the art can be effected within the spirit and scope of the present invention defined in the appended claims.

As described above, in the NRD waveguide modulator having a waveguide type hybrid coupler according to the present invention, a waveguide type 180° hybrid coupler and waveguides are integrally formed in a conducting housing by mechanical processing such that more consistent and superior characteristics compared to the prior art directional coupler using NRD waveguides can be obtained. Furthermore, a circulator in the prior art apparatus is removed and the modulator part is formed as NRD waveguides such that manufacturing is simplified, transmission loss is reduced, and transmission efficiency is enhanced. Consequently, the consistency of characteristics of an apparatus can be maintained and in addition, the structure is simplified and the manufacturing processes are reduced such that manufacturing time and cost can be reduced.

Also, by disposing transition units between waveguides and RND waveguides, an amplifier and a diplexer whose I/O ports are waveguides can be mounted on a modulated signal output port such that compatibility between a waveguide apparatus and an NRD waveguide apparatus can be provided.

What is claimed is:

1. A non-radiative dielectric (NRD) waveguide modulator comprising:

a conducting housing which comprises a lower conducting plate and an upper conducting plate combined with the lower conducting plate;

a hybrid coupler which is disposed inside the conducting housing and is formed in a structure in which a plurality of waveguides processed as conduit-shape cavities are connected to the outer surface of a ring portion processed as a ring-shape cavity, the plurality of waveguides having a predetermined phase difference and being extended in a radial direction, wherein a local oscillation signal input through any one of the plurality of waveguides is distributed to at least two waveguides and propagated;

a modulator in which a dielectric line, which includes a diode mount on which a Schottky diode is mounted, is solidly disposed inside a modulator cavity inside the conducting housing, and the dielectric line is connected to any one waveguide of the hybrid coupler, and which modulates a local oscillation signal input through the dielectric line by using the Schottky diode and outputs the modulated signal to the outside; and a termination which is connected to an end of any one waveguide terminating the local oscillation signal, among the plurality of waveguides of the hybrid coupler, and terminates a signal reflected by the modulator by consuming the signal internally.

2. The NRD waveguide modulator of claim 1, wherein the plurality of waveguides of the hybrid coupler includes four waveguides, and two waveguides through which the local oscillation signal is distributed are separated by a gap so as to provide a phase difference of 180° to the local oscillation signal.

3. The NRD waveguide modulator of claim 2, wherein among the four waveguides, a signal input port to which the local oscillation signal is input is formed in a first waveguide, a modulator input port through which a signal is transferred to the modulator is formed in a second waveguide, a mixer input port which is connected to a mixer of a reception unit is formed in a third waveguide, and an isolation port which is connected to the termination is formed in a fourth waveguide, and the second and third waveguides have an identical phase from the first waveguide so that the local oscillation signal transferred through the ring portion is distributed to the second and third waveguides with each distributed signal having the same power.

4. The NRD waveguide modulator of claim 3, wherein the termination comprises:

a fifth waveguide which has a cavity shape connected to the fourth waveguide, with a height half that of the fourth waveguide;

a sheet mounting cavity of which width extends from the fifth waveguide;

a resisting sheet which is solidly mounted on the sheet mounting cavity; and a termination upper conducting plate which is solidly disposed on the top part of the resisting sheet and on which a waveguide groove, which is combined with the fifth waveguide to provide a waveguide with a height the same as that of the fourth waveguide, is formed.

5. The NRD waveguide modulator of claim 3, further comprising:

a front side transition which transforms a signal path between the second waveguide and the dielectric line, at the front end part of the modulator; and a back side transition which transforms a signal path between the dielectric line of the modulator and a waveguide for outputting a modulated signal, at the back end part of the modulator, wherein the waveguide for outputting a modulated signal extends from the back end part of the modulator and at the other end part of the waveguide a modulated signal output port is formed.

6. The NRD waveguide modulator of claim 5, wherein the transition is formed by shortening the distance of the side walls contacting the waveguide, of the modulator cavity in which the dielectric line is disposed, and the length of the transition is $\lambda g/4$.

7. The NRD waveguide modulator of claim 6, wherein the dielectric line of the modulator comprises the front side dielectric line connected to the second waveguide and the back side dielectric line connected to the waveguide at the modulated signal output side, and the diode mount is disposed between the front side and back side dielectric lines, and a line position groove into which a predetermined part of the dielectric lines is inserted is formed on the upper conducting plate contacting the top surfaces of the dielectric lines and a line support groove into which a predetermined part of the dielectric lines is inserted is formed on the lower conducting plate contacting the bottom surfaces of the dielectric lines.

8. The NRD waveguide modulator of claim 7, wherein in order to match impedances of the dielectric line and the diode mount at the frequency of the entered local oscillation signal, a high dielectric constant sheet is inserted between the front side dielectric line and the diode mount, and a patch antenna appropriate to the frequency is prepared in the diode mount.

* * * * *